US006394824B1

(12) United States Patent
Huang

(10) Patent No.: US 6,394,824 B1
(45) Date of Patent: May 28, 2002

(54) ELECTRICAL CONNECTOR

(75) Inventor: Wayne Huang, Alhambra, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/826,995

(22) Filed: Apr. 4, 2001

(51) Int. Cl.[7] ..... H01R 13/648
(52) U.S. Cl. ..... 439/108; 439/610; 439/358
(58) Field of Search ..... 439/108, 607, 439/608, 610, 110, 350, 357, 358

(56) References Cited

U.S. PATENT DOCUMENTS 6,257,914 B1 * 7/2001 Comevir et al. ..... 439/607
6,290,530 B1 * 9/2001 Chang ..... 439/610
6,328,601 B1 * 12/2001 Yip et al. ..... 439/610

* cited by examiner

*Primary Examiner*—Hien Vu
(74) *Attorney, Agent, or Firm*—Wei Te Chung

(57) ABSTRACT

An electrical connector, comprises a lower half defining a supporting socket adjacent to a first end thereof and an upper half is assembled to the lower half. A latch is pivotably assembled to the supporting socket of the lower half. A grounding device is attached to the upper half for electrically establishing a grounding path to a receptacle in which the electrical connector is mated. Interengaging device formed between the upper and lower halves and includes a pair of recesses defined in the lower half, and a pair of latching legs snugly received in the recesses.

3 Claims, 8 Drawing Sheets

ELECTRICAL CONNECTOR

FIELD OF THE INVENTION

The present invention relates to an electrical connector, and more particularly to an electrical connector having a plastic latch pivotally assembled thereto. The electrical connector further includes a grounding device for establishing a grounding path with a receptacle in which the electrical connector is mated.

DESCRIPTION OF THE PRIOR ART

Electrical connector with latches is widely used between plug and receptacle connectors to ensure reliable electrical connection therebetween. However, in some circumstance, such as when the plug is made from die-cast, a grounding path is required between the plug and the receptacle.

One of the approaches is to provide a metal latch which functions engagement as well as grounding. However, it is preferable to perform the engagement and grounding between the plug and receptacle separately.

FIGS. 8A and 8B disclose an approach suggested by Small Form Factor Committee on the HSSDC-2, SFF-8421, Page 17.

SUMMARY OF THE INVENTION

It is an object of this invention to provide an electrical connector in which a plastic latch and grounding device are separately formed thereon to provide a reliable electrical connection as well as grounding.

In order to achieve the objective set forth, an electrical connector in accordance with the present invention comprises a lower half defining a supporting socket adjacent to a first end thereof and an upper half is assembled to the lower half. A latch is pivotally assembled to the supporting socket of the lower half. A grounding device is attached to the upper half for electrically establishing a grounding path to a receptacle in which the electrical connector is mated. Interengaging device formed between the upper and lower halves and includes a pair of recesses defined in the lower half, and a pair of latching legs snugly received in the recesses.

SUMMARY OF THE DRAWINGS

Other objects and further features of the present invention will be apparent from the following detailed description when read in conjunction with the accompanying drawings, in which.

DETAILED DESCRIPTION OF PREFERRED EMBODIMENT

Figure 1:
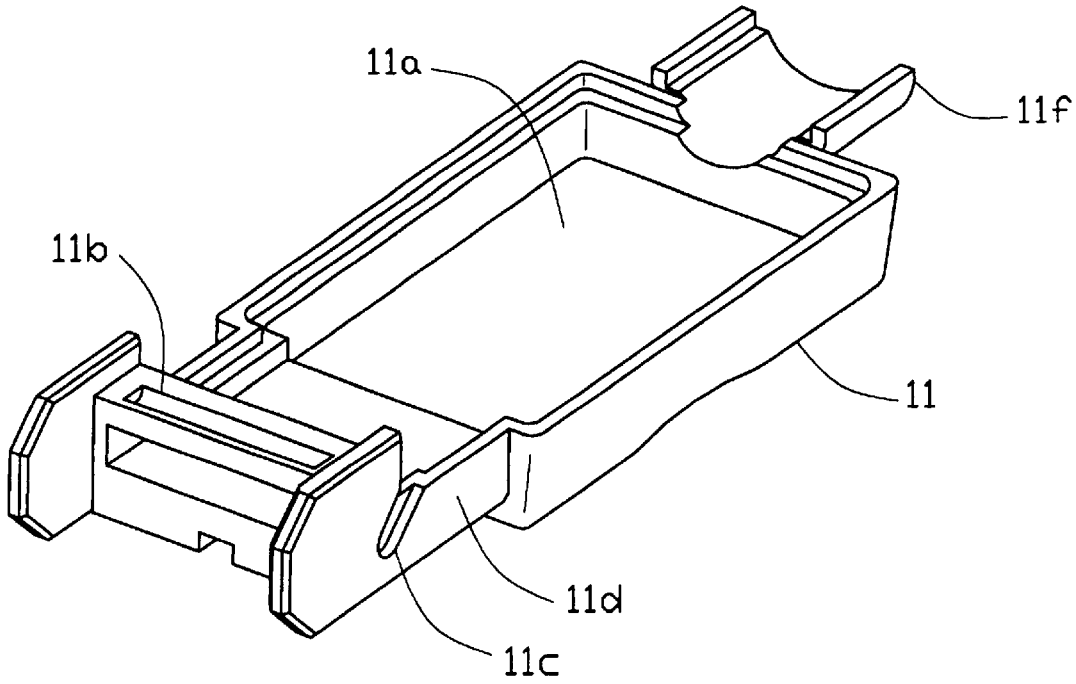
FIG. 1 is a perspective view of a lower half of a housing of an electrical connector in accordance with the present invention.
Figure 2:
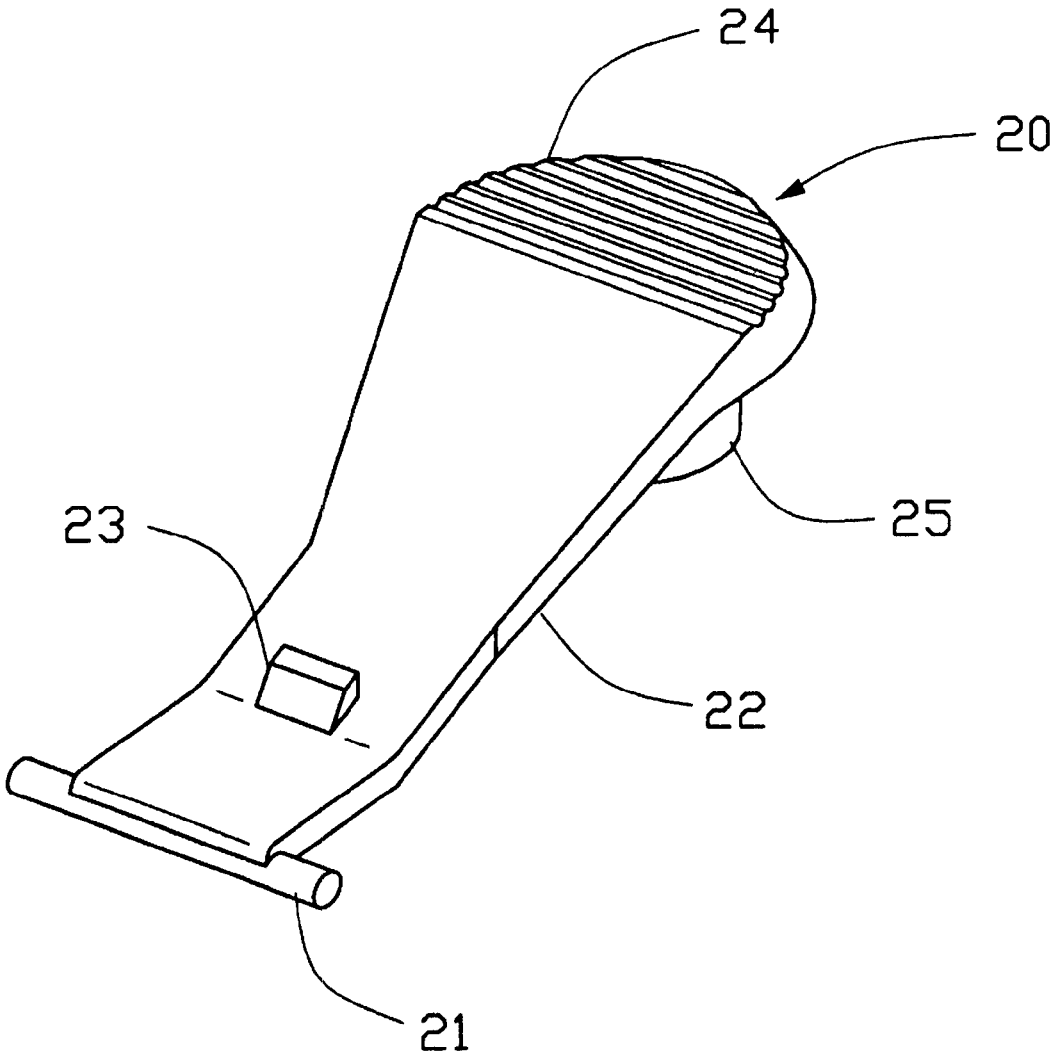
FIG. 2 is a perspective view of a latch in accordance with the present invention.
Figure 3:
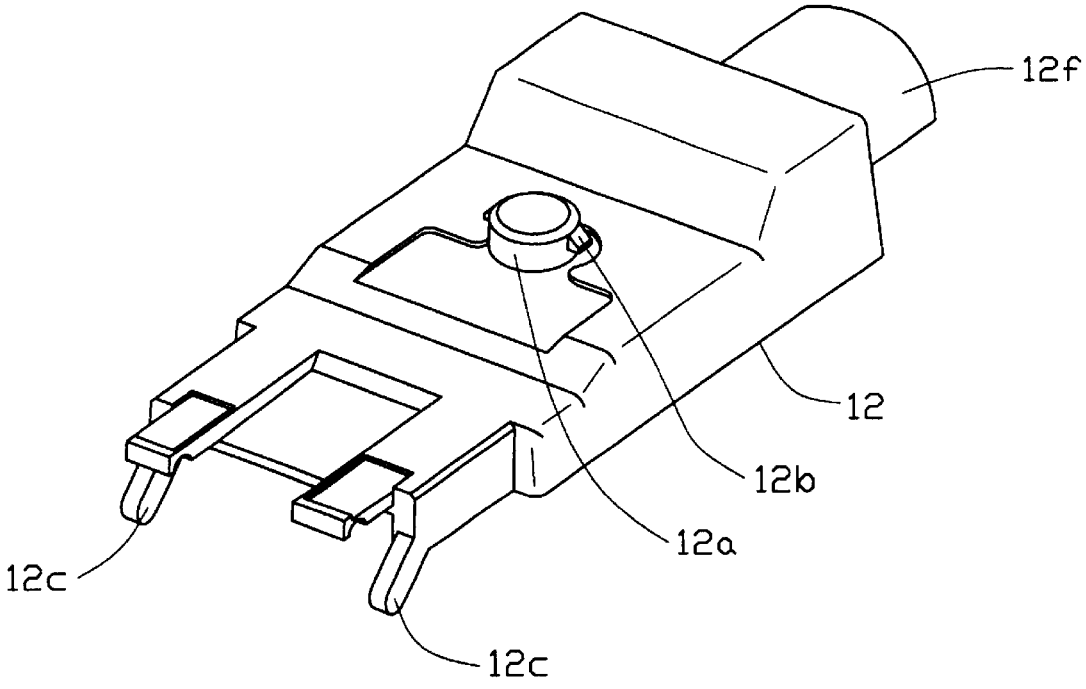
FIG. 3 is a perspective view in which the latch is assembled to the lower half.
Figure 4:
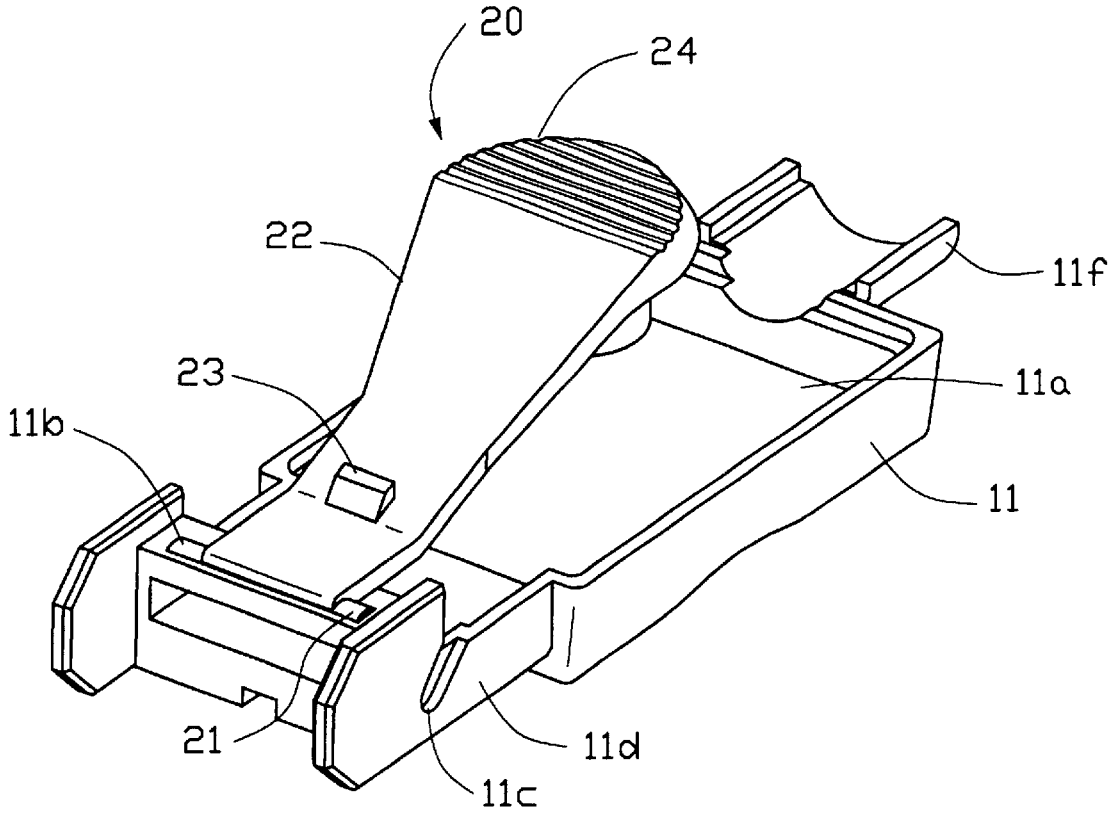
FIG. 4 is a perspective view of an upper half to be assembled to the lower half of FIG. 1.
Figure 5:
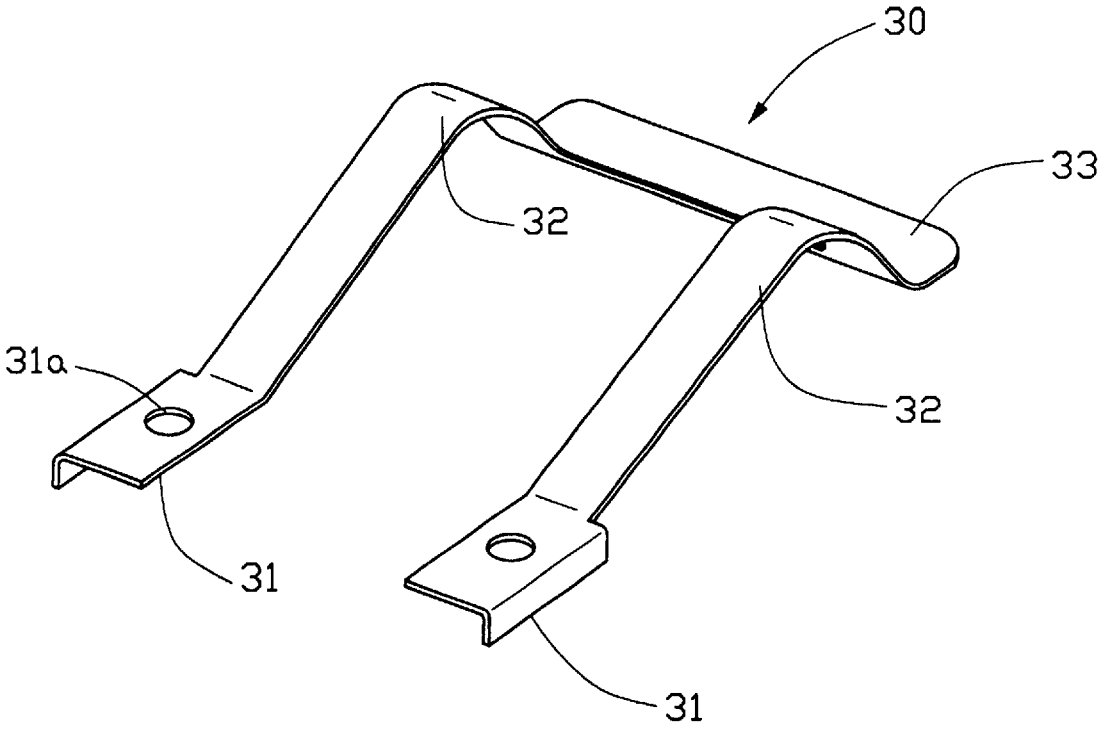
FIG. 5 is a perspective view of a grounding tab assembled to the upper half of the housing.

Referring to FIGS. 1 to 7, an electrical connector 1 in accordance with the present invention includes a housing 10 configured by a lower half 11, and an upper half 12 assembled to the lower half 11. The lower half 11 defines a receiving space 11*a* in a middle thereof for receiving electrical components, such as conductive wires and printed circuit board (not shown). The lower half 11 further includes a supporting socket 11*b* adjacent to a first end thereof. A pair of recesses 11*c* is defined in sidewall 11*d* of the lower half 11 adjacent to the first end.

A plastic latch 20 includes an anchoring shaft 21 rotationally received in the supporting socket 11*b* of the lower half 11. The latch 20 includes a plate portion 22 on which a clip 23 projecting therefrom for engaging with a window defined in a receptacle (not shown). The plate portion 22 further includes a grip portion 24 for easy manipulation of a finger. The latch 20 further includes a hollow spring seat 25 at a bottom face thereof for receiving a coil spring 26 therein. The coil spring 26 received in the spring seat 25, surrounds the post 12*a* of the upper half 12 and retained by the mounting ear 12*b* of the upper half 12.

An upper half 12 is mateable with the lower half 11 to configure the housing 10. After the upper half 12 is assembled to the lower half 11, the shaft 21 of the latch 20 is rotationally arranged between the upper and the lower halves 12, 11. In addition, the latch 20 projects upward above a top face of the upper half 12. As the coil spring 26 is seated between the latch 20 and the upper half 12, the latch 20 is pushed upward such that the clip 23 is provided with locking force to engage with a receptacle shown in FIG. 8.

In order to facilitate a robust engagement between the lower and upper halves 11, 12, the recesses 11*c* is defined obliquely in the sidewall 11*d* of the lower half 11, while the upper half 12 is provided with a pair of anchoring legs 12*c* corresponding to the recesses 11*c*. The obliquely arranged recesses 11*c* and the anchoring legs 12*c* will make the assembly of the lower and upper halves 11, 12 more easy. After the lower and upper halves 11, 12 are assembled, a ferrule (not shown) can be attached to the tail portions 11*f*, 12*f*such that the lower and upper halves 11, 12 are securely fastened.

A grounding tab 30 is fixedly attached to the upper half 11 adjacent to a first end thereof. The grounding tab 30 includes a pair of leg portions 31 fixedly attached to the upper half 11. In this embodiment, two retaining posts (not shown) of the upper half 12 may extend through the corresponding holes 31*a* in the leg portions 31 with a deformed enlarged head (not shown) for holding the leg portions 31 in position. A pair of spring arms 32 project upward and are interconnected by a link 33 at free ends of the spring arms 32. The link 33 moveably rests on an upper face of the upper half 12. When the spring arms 32 are in contact with the receptacle, the spring arms 32 are depressed such that the link 33 moves forward to compensate the downward deformation of the spring arms 32. Once the spring arms 32 are removed from the receptacle, the spring arms 32 bounce back and the link 33 resumes to its original position.

Figure 8A:
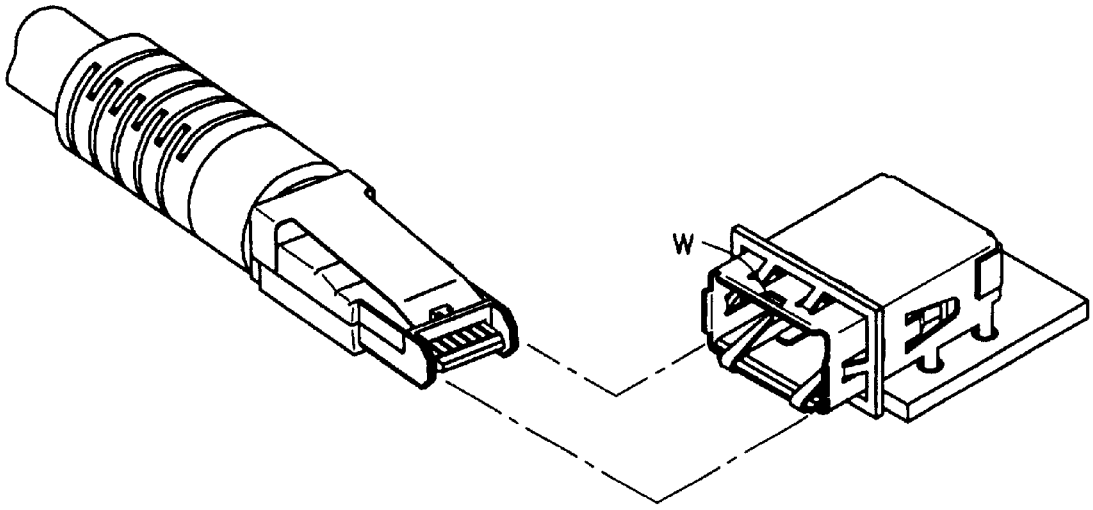
FIGS. 8A and 8B are perspective views showing a plug and receptacle arrangement specified in a HSSDC-2 Standard.
Figure 8B:
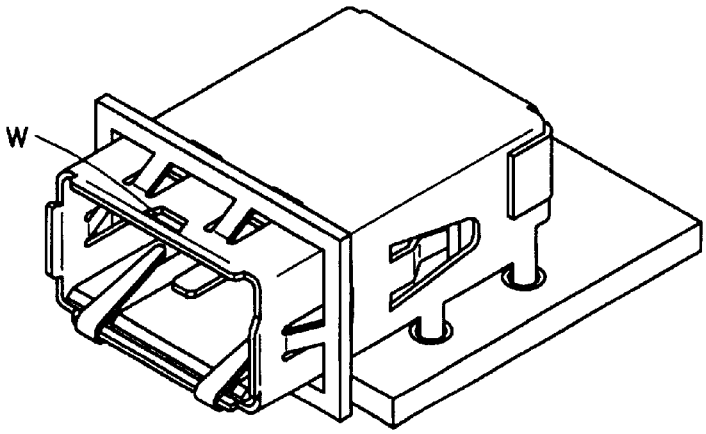

When the connector 1 made according to the present invention is to be coupled to the receptacle in FIG. 8, the user can easily insert the connector 1 into the receptacle such that the clip 23 of the latch 20 engages with a window (w) formed on the receptacle. Meanwhile, the spring arms 32 are also electrically connecting with inner upper wall of the receptacle such that an electrical grounding path is established between the upper half 12 and the receptacle. This will further lower the EMI.

Upon the removal of the connector 1 from the receptacle, the user can easily press down the grip portion 24 of the latch 20 to disengage the connection between the clip 23 and the window (w). Accordingly, the connector 1 can be easily pulled out from the receptacle.

One of the advantages of the present invention is that the grounding tab 30 and the latch 20 functions independently from each other instead of mixing together. The grounding path established by the prior art, as shown in FIG. 8, is merely by the contact between the metal latch and the upper wall of the receptacle. In addition, the metal latch serves also a lock to the receptacle, those two parameters have to be carefully controlled to ensure a reliable grounding and lock. No doubt this will increase the difficulty and complexity of the manufacturing process.

On the other hand, as explained above, the grounding path is established based on a reliable contact between the metal latch and a front edge of the upper wall of the receptacle. The risk is the tolerance between locks will give a room such that the latch is not electrically contact with the front edge of the receptacle. In this case, the signal transmission will be damaged.

In the present invention, since the latch 20 and the grounding tab 30 functions differently, their design can be easily controlled to facilitate their intended function without influencing from each other. As long as the grounding tab 30 moves into the receptacle, the grounding path between the connector 1 and the receptacle is established. However, in the prior art, unless the latch is locked with the receptacle, the grounding path is not ensured. This will not doubt create a problem for signal transmission, especially in high speed.

Figure 6:
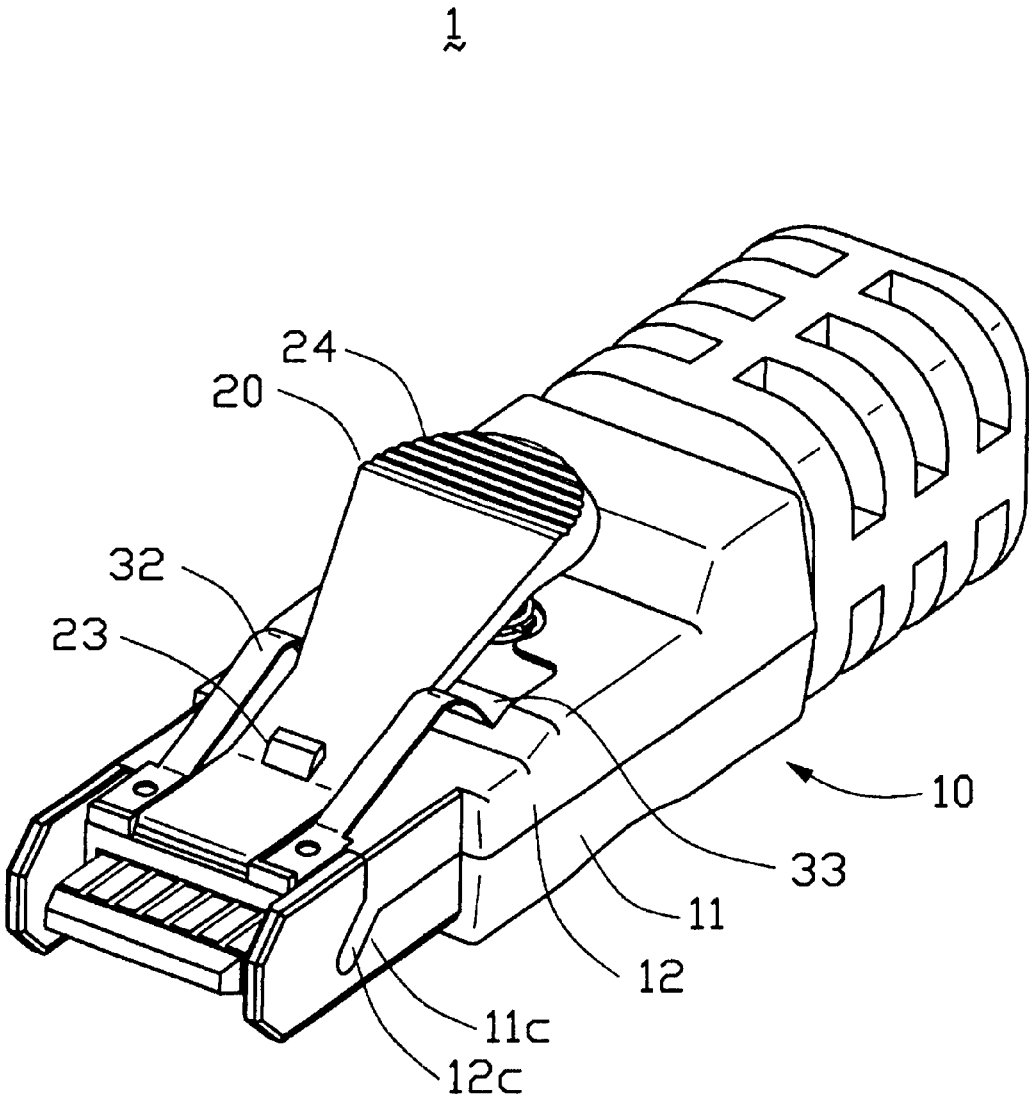
FIG. 6 is a perspective view of the electrical connector in which all elements are assembled.
Figure 7:
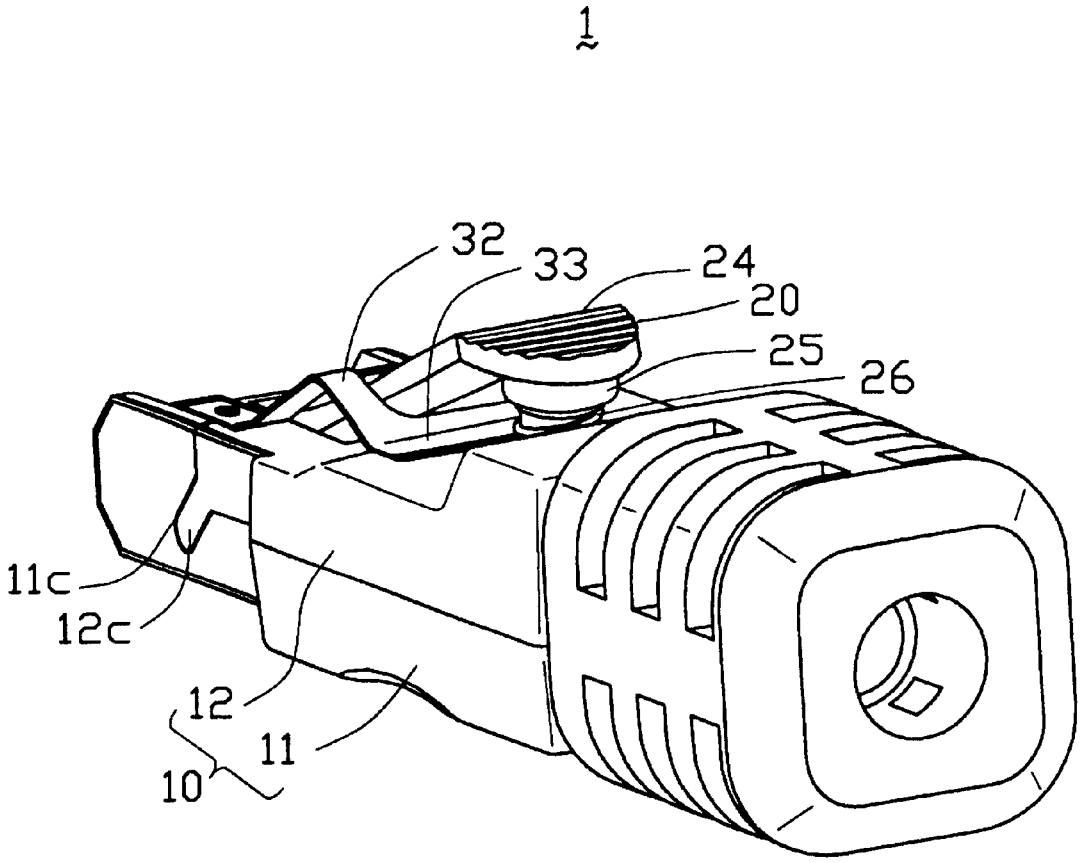
FIG. 7 is a perspective view of the electrical connector viewed from a reverse direction of FIG. 6.

In the present invention, as shown in FIG. 6, the spring arms 32 is higher than the clip 23, as result, the spring arm 32 will effectively engage with upper wall of the receptacle to establish a reliable grounding path.

I claim:

1. An electrical connector, comprising a lower half defining a supporting socket adjacent to a first end thereof;

an upper half assembled to the lower half;

a latch pivotally assembled to said supporting socket of said lower half;

a grounding device attached to the upper half for electrically establishing a grounding path to a receptacle in which the electrical connector is mated; and interengaging means formed between the upper and lower halves and including a pair of recesses defined in the lower half, and a pair of anchoring legs extending outwardly from said upper half and snugly received in said recesses; wherein said upper half includes a supporting post on which a spring is seated to provide an upward biasing force to the latch; wherein said grounding device includes a pair of spring arms projecting upward from a top face of the upper half; wherein said recesses are defined obliquely with respect to a visual horizontal surface of said lower half.

2. An electrical connector assembly comprising:

a receptacle connector including a metal shroud enclosing a first mating port therein, said metal shroud defining a locking window around a front portion thereof;

a plug connector including:

an insulative housing with a second mating portion extending therefrom;

a plastic latch deflectably extending reawardly from proximate the second mating portion with a clip formed around said second mating portion;

a grounding tab fastened to a top face of the housing with at least one spring arm extending along the same direction with the plastic latch while being spaced from said latch in a horizontal direction; and interengaging means formed between upper and lower halves and including a pair of recesses defined in the lower half and a pair of anchoring legs extending outwardly from said upper half and snugly received is said recesses; wherein when the plug connector and the receptacle connector are mated with each other, the clip is received within the locking window and the spring arm engages the shroud; wherein said recesses are defined obliquely with respect to a visual horizontal surface of said lower half; wherein said grounding tab includes two spaced spring arms connected by a link which is located under a grip portion which is positioned at a distal free end of said plastic latch.

3. The assembly as recited in claim 2, wherein said two spaced spring arms are positioned by two sides of the latch, respectively.

* * * * *